United States Patent [19]

Cronin

[11] 4,330,023

[45] May 18, 1982

[54] EXTENDED NIP PRESS

[75] Inventor: Dennis C. Cronin, Rockton, Ill.

[73] Assignee: Beloit Corporation, Beloit, Wis.

[21] Appl. No.: 179,059

[22] Filed: Aug. 18, 1980

[51] Int. Cl.[3] ..... D21F 3/02; D21F 3/08

[52] U.S. Cl. ..... 162/358; 100/153; 162/361

[58] Field of Search ..... 162/358, 205, 361, DIG. 1; 100/118, 151–154; 198/626, 847; 474/237, 264, 268; 428/157, 172, 295

[56] References Cited

U.S. PATENT DOCUMENTS

| | | | |
|---|---|---|---|
| 1,592,416 | 7/1926 | Brownwell | 474/237 |
| 3,446,139 | 5/1969 | Coffelt | 100/151 |
| 3,492,200 | 1/1970 | McKie et al. | 162/358 |
| 3,853,698 | 12/1974 | Mohr | 162/358 |
| 4,238,287 | 12/1980 | Gill | 162/358 |

*Primary Examiner*—Marc S. Alvo

*Attorney, Agent, or Firm*—Dirk J. Veneman; Michael L. Gill; Gerald A. Mathews

[57] ABSTRACT

A press section for extracting water from a continuous traveling web in which the web is sandwiched between a traveling belt and a drum. The belt is wrapped partially about the drum and a pressure shoe exerts pressure on the belt in the wrap area to press the web. The laterally outer ends of the drum are relieved to provide a reduced diameter portion in the areas extending laterally outwardly of the pressure shoe.

7 Claims, 5 Drawing Figures

FIG.-1
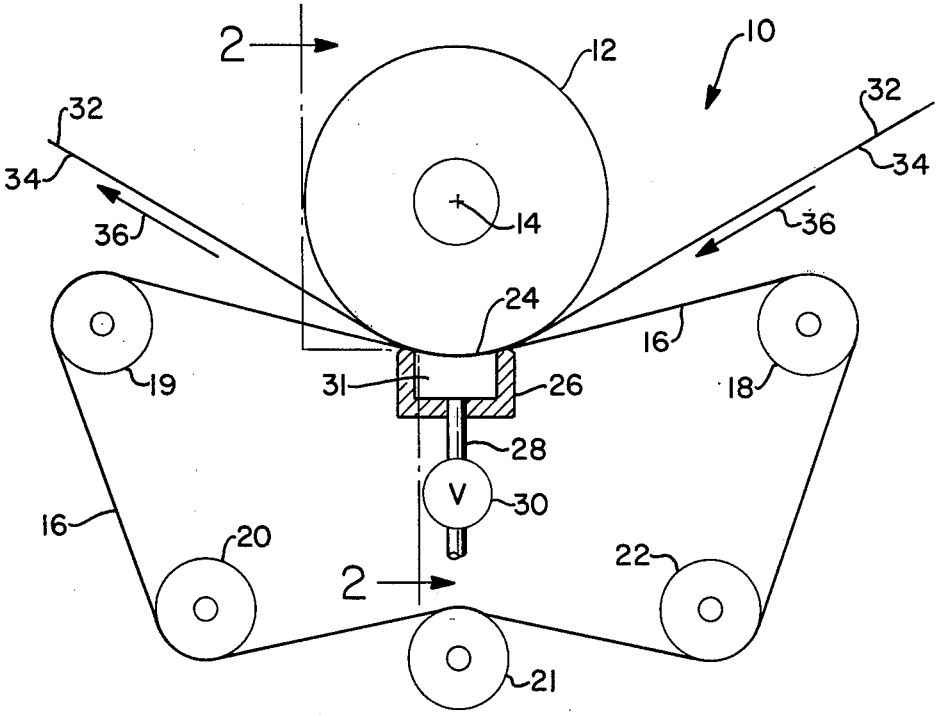
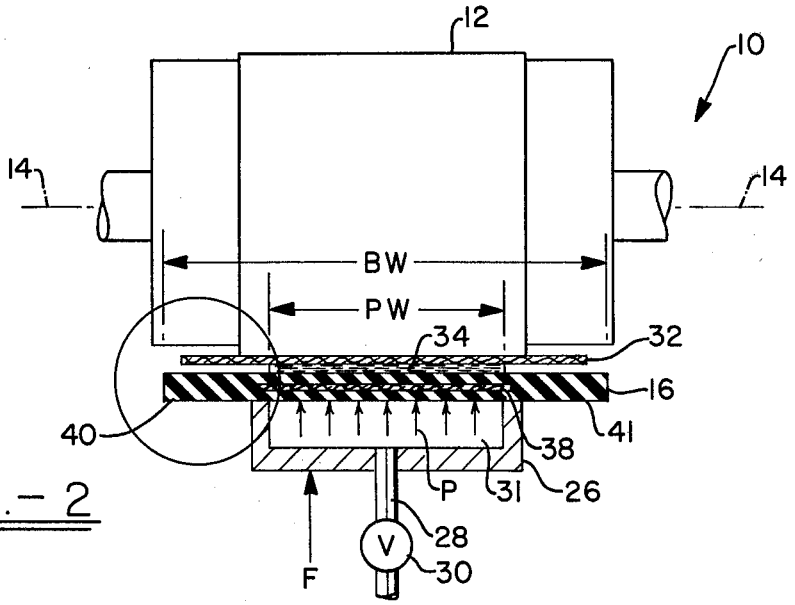
FIG.-2

EXTENDED NIP PRESS

BACKGROUND OF THE INVENTION

The foregoing abstract is not to be taken as limiting the invention of this application, and in order to understand the full nature and extent of the technical disclosure of this application, reference must be made to the accompanying drawings and the following detailed description.

This invention relates to presses for extracting water from a continuous traveling web and particularly to such a press section for extracting water from a newly formed web of paper in a papermaking machine. More particularly it relates to an extended nip press structure of the type including a pressure shoe and a traveling endless belt.

While the present invention relates to dewatering of a continuously running web of any material, it will be described herein with respect to the specific process of dewatering a web of paper. In the papermaking process, the web is formed by depositing the slurry of pulp fibers on a traveling wire. A large portion of the water is normally extracted from the web in the forming area by gravity or suction. The web then passes through what is known as a press section which normally would involve a series of nips of pairs of roll couples in which a substantial amount of the remaining water is squeezed out. The web will then pass on to a drying section which normally is composed of a series of heated drums to drive water off by vaporization. The web then finally passes to such finishing operations as calendering, coating, slitting, winding, et cetera.

The present invention relates specifically to a particular type of press section wherein the pressing operation in each unit is extended in time and thereby results in the extraction of significantly more water than in the heretofore nip of a roll couple. This extended nip pressing is accomplished by wrapping an endless belt about an arc of a rotating drum. The web is sandwiched between the endless belt and the drum and will have a traveling felt on one or both sides thereof for absorbing the water from the web. Additional pressure is provided to the arc of contact area by means of a pressure shoe located on the side of the belt opposite the drum.

The principles and advantages of extended nip pressing have been discussed in U.S. Pat. Nos. 3,798,121 and 3,853,698, both of which are assigned to the assignee of this invention. These principles and advantages, therefore, need not be discussed herein. The present invention, however, is related to an extended nip press of the type disclosed in U.S. Pat. No. 3,853,698 wherein a pressure shoe located on the side of the belt opposite the drum to generate high pressing forces against the web. This is to be distinguished from the type disclosed in aforesaid U.S. Pat. No. 3,798,121 in which the pressure is provided by tension in one or more belts as they pass about the drum.

In the operation of such extended nip press sections having a pressure shoe, a problem has evolved wherein a bulge or bow forms ahead of the nip. The exact phenomenon which causes this bow or bulge is not fully understood. It is clear, however, that the center portion of the endless belt in the area of the shoe is compressed, heated by the oil and friction and is otherwise worked differently than the rather wide edges of the belt. The bulge will sometimes be centered on the belt and at other times will be off to one lateral side of the belt. It will sometimes appear on the downstream side of the shoe on the laterally opposite side of the belt relative to a bulge on the upstream side of the shoe. Experience thus far shows that the bulge is always confined in lateral directions to the shoe area.

Needless to say, this bulge in the belt is undesirable for many reasons, among which is the fact that it can cause wrinkling or creasing of the web. While the bulge can be eliminated by increasing the tension on the belt, this is not fully satisfactory since it causes increased loading on belts, shafts, bearings and drives. This in turn results in a decrease in the service life of such components and an increase in power consumption and down time.

The complexity of the operating conditions renders a solution to the problem evasive. Presently, pressure shoes having a 10 inch (25.4 centimeters) arc of contact and pressures of 600 pounds per square inch (42 kilograms per square centimeter) are utilized in experimental machines. This means that the belt is subjected to 6,000 pounds of normal force for every inch (1071 kilograms per centimeter) of width of the belt in the shoe area. Further, it is contemplated that pressures may be increased to 900 pounds per square inch (63 kilograms per square centimeter) or above, and arcs of contact might be increased to as much as 20 inches (50.8 centimeters) or more. A 20 inch (50.8 centimeter) arc of contact and shoe pressures of 900 psi (63 kilograms per square centimeter) would result in 18,000 pounds of normal force for each inch (3213 kilograms per centimeter) of width of the belt in the shoe area.

Further, since the belt is in sliding contact with the shoe and under extremely high pressure, significant heat can be generated due to the sliding friction. The hydraulic fluid in the shoe is maintained at 140° Fahrenheit (46° Centrigrade) to maintain the proper viscosity. With the heat caused by the sliding friction and hysteresis losses in the belt added to the heat from the oil, it is believed that belt temperatures may approach 200° Fahrenheit (79° Centrigrade).

In my co-pending U.S. Pat. No. 4,229,253, filed Apr. 26, 1979, (assigned to the same assignee as this invention) it is suggested that longitudinally extending cords be provided only in the area of the belt which passes through the pressure shoe area. It is further noted in said co-pending application that by providing such longitudinals cord in the shoe area only, a substantial reduction in the tension required to eliminate the bulge is realized.

In co-pending U.S. Pat. No. 4,229,254, filed Apr. 26, 1979, (assigned to the same assignee as this invention) it is proposed that the longitudinal reinforcing structure be comprised of at least a pair of layers of cords extending respectively at equal but opposite small angles with respect to the longitudinal direction of the belt. In that co-pending application, it is noted that if the cord angle with respect to longitudinal direction is low and the modulus elasticity of the cords is sufficiently high, proper circumferential resistance can be provided and at the same time possible side to side variations and tensions throughout the shoe area can be balanced.

In co-pending U.S. Pat. No. 4,238,287, filed Apr. 26, 1979, it is suggested that a transverse stiffening system be provided which resists the bending necessary to form the bulge ahead of the shoe area.

In accordance with the present invention, yet another method and means of reducing the tension required to draw the bubble or bulge out of the belt is proposed. This concept can be used in conjunction with one or more of the three aforementioned techniques of reducing this required tension or in place of these techniques.

More particularly, the present invention involves the relieving of the lateral edge contact area between the belt and the drum which is disposed laterally outside the pressure shoe area. In the preferred embodiment, a reduced diameter portion is provided in the laterally outer portions of the rotating drum. Alternatively, a reduced thickness or cutaway portion can be provided in the continuous belt in the area corresponding to these portions laterally outside the pressure shoe. Lastly, relieved laterally outer portions can be provided on both the endless belt and the rotating drum.

An object, therefore, of the present invention is to provide relief in a laterally outer portion of the rotating drum and endless belt combination in an extended nip press to reduce the tension required to eliminate bubbles in the belt adjacent the nip of an extended nip press structure.

Other objects, advantages and features will become more apparent with the disclosure of the principles of the invention and it will be apparent that equivalent structures and methods may be employed within the principles and scope of the invention in connection with the description of the preferred embodiment and the teaching of the principles in the specification, claims and drawings.

DESCRIPTION OF THE DRAWINGS

FIG. 1 is a schematic side view of a press section of a papermaking machine;

FIG. 2 is a partial cross-sectional view of the apparatus of FIG. 1 taken substantially along line 2—2 and illustrating the present invention;

DESCRIPTION OF THE PREFERRED EMBODIMENT

Figure 3:
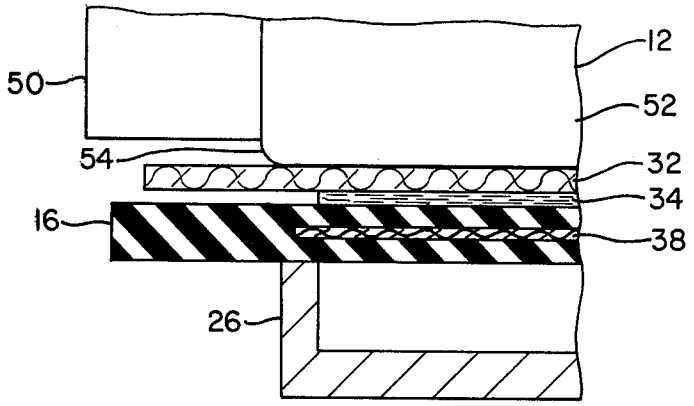
FIG. 3 is an enlarged partial sectional view as illustrated in FIG. 2, but showing only one lateral edge portion of the belt and rotating drum combination.

With reference to the drawings, and in particular FIG. 1, there is illustrated a schematic side elevational view of an extended nip press section 10 of a papermaking machine. The press section 10 includes a press roll 12 rotatable about an axis 14 which extends transversely of the press section. For purposes of this invention, lateral or transverse directions shall be directions which extend parallel to the rotational axis 14 of the press roll 12. Also, longitudinal or circumferential directions shall be directions which extend parallel to the direction of motion of the belt or web of paper.

A flexible endless belt 16 is trained about a plurality of pulleys 18 through 22 which are arranged in such a fashion with respect to the press roll 12 that the belt 16 wraps about a portion of the roll 12 to form an arcuate press area 24. One or more of the pulleys 18 through 22 are mounted in a known manner for movement in directions perpendicular to their respective rotational axis to permit installation of the belt 16 and adjustment of the tension in the belt 16.

An arcuate pressure shoe 26 is disposed adjacent the belt 16 on the side thereof opposite the roll 12 and press area 24. A force F is exerted on the pressure shoe by any suitable means to exert a pressure on the belt 16 in the press area. To insure even pressure P across the belt 16 in this area, and minimize sliding friction, hydraulic pressure is supplied through a pipe 28 to a cavity 31. The pressure is regulated by means of a valve 30. The specific mechanical and hydraulic operation of the pressure shoe forms no part of the present invention and, therefore, will not be discussed herein in further detail. Further, although a pressure shoe 26 with a fluid cavity 31 is illustrated, it will be appreciated that a solid pressure shoe with an arcuate surface to mate with the roll 12 could be utilized. For a specific example of a pressure shoe, reference may be had to U.S. Pat. No. 3,853,698.

A felt 32 is trained about the press roll 12 and passes between the press roll 12 and the belt 16. A web of material 34 to be dewatered, is applied to the felt 32 and carried through the press area 24 in the direction of the arrows 36. While only one felt 32 is illustrated, it will be appreciated that a double felt system could be utilized wherein the web of paper or other similar material 34 is sandwiched therebetween.

As best seen in FIG. 2, the pressure shoe 26 is disposed in the transverse center area of the roll 12 and belt 16. The width PW of the pressure shoe is substantially less than the width BW of the belt and, therefore, exerts a pressure only over the center portion of the moving belt. This leaves the laterally outer portions 40,41 free of any normal force or pressure caused by the pressure shoe 26.

As discussed above, during the operation of such an extended nip press, a problem has arisen wherein a bulge or bow appears in the belt 16 on the ingoing side of the nip at various positions across the width PW of the pressure shoe. The bulge or bow can occur in a central location with respect to the shoe or at either lateral side of the shoe. Further, the bulge will sometimes appear at one lateral side of the shoe on the upstream side and at the opposite lateral side of the shoe on the downstream side.

In accordance with the present invention, and with reference to FIG. 3, there is illustrated the assembly of one laterally outer portion of the pressure shoe, endless belt and rotating drum assembly. The laterally outer portion 50 of the drum 12 has a reduced diameter relative to the diameter of the central portion 52. Preferably the diameter of the laterally outer portion 50 is between 80 and 160 thousandths of an inch less than the diameter of the central portion 52. The laterally outer shoulder 54 of the central portion of the drum 52 is provided with a radiused corner or tapering reduction in diameter to eliminate excessive concentration of pressure and resulted wear in that area of the belt 16.

Figure 4:
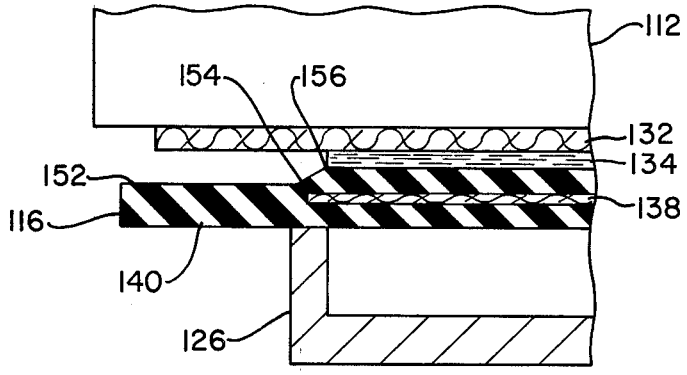
FIG. 4 is a view similar to FIG. 3 showing an alternate embodiment of the present invention.

Alternatively, and with respect to FIG. 4, there is illustrated a further means for relieving the inner action between the belt 116 and the drum 112. As before, a felt 132 carries a web to be dewatered through the press area. In this particular embodiment, a reduced thickness portion 140 is provided by relieving the side 152 adjacent the drum 112 throughout the laterally outer portion which extends laterally outwardly with respect to the pressure shoe 126. This step-off 154 should be between 80 and 160 thousandths of an inch, and again would be provided with a gradual change in thickness in the area 156 adjacent the laterally outer edge of the pressure shoe 126.

Figure 5:
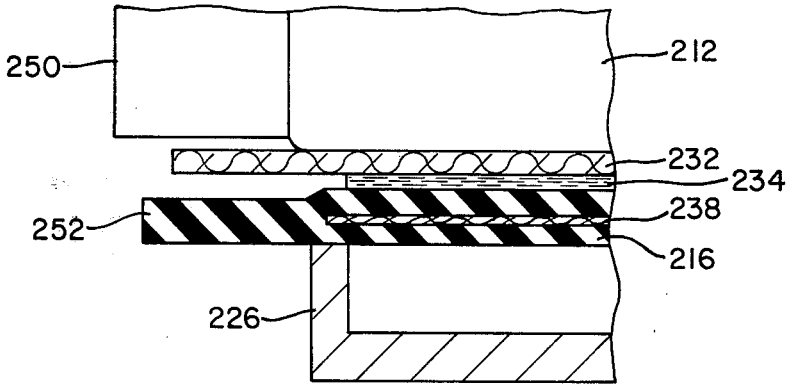
FIG. 5 is a view similar to FIG. 3 showing yet another alternate embodiment of the present invention.

In yet a further embodiment of the invention illustrated in FIG. 5, a web 234 to be dewatered is sandwiched between a bolt 216 and felt 232 as it passes between a drum 212 and a pressure shoe 226. The laterally outer portions 250 of the drum 212 and 252 of the belt 216 are relieved on the mutually facing surfaces thereof. The total of the step-off in the laterally outer portion 250 of the drum 212 and the laterally outer portion 252 of the belt 216 should be between 80 and 160 thousandths of an inch. This can be provided in equal portions on the drum 212 and belt 216, or in relatively larger or smaller amounts in the drum 212 or belt 216.

It can thus be seen that in all three embodiments of FIGS. 3, 4 and 5, the surface of the belt adjacent the pressure shoe and the surface of the roll opposite the pressure shoe are substantially parallel to each other in lateral directions. It can further be seen that the distance between the surface of the belt and the surface of the roll gradually increases adjacent each laterally outer edge of the pressure shoe to provide the aforementioned step-off.

As seen in FIGS. 2 and 3, the belt 16 includes a reinforcing structure 38 (138 in FIG. 4 and 238 in FIG. 5) extending circumferentially thereof. This reinforcing structure may include one or more of the features disclosed and described in the aforementioned U.S. Pat. Nos. 4,229,253; 4,229,254; and 4,238,287.

While a certain representative embodiment and details have been shown for the purpose of illustrating the invention, it will be apparent to those skilled in this art that various changes and modifications may be made therein without departing from the spirit or scope of the invention.

What is claimed is:

1. An extended nip press for removing water from a moving web of material, said press comprising:

a rotatable roll having a cylindrical outer surface;

a flexible endless belt trained about a plurality of pulleys and having a belt surface such that said belt turns about the surface of said roll over an arc of contact and said belt surface faces said roll;

at least one movable felt means trained about said roll between said belt and said roll for carrying said web of material between said belt and said roll;

a pressure shoe disposed on the side of said belt opposite said roll surface and adjacent said arc of contact, said shoe terminating in lateral directions at edges substantially short of the lateral edges of said belt; and the surface of the belt adjacent the pressure shoe, and the surface of the roll opposite the pressure shoe being substantially parallel to each other in the lateral direction, the distance between the surface of the belt and the surface of the roll gradually increasing adjacent the lateral outer edges of the pressure shoe.

2. An extended nip press as claimed in claim 1 wherein said roll has a reduced diameter portion throughout the area of said roll extending laterally outwardly said pressure shoe.

3. A press as claimed in claim 2 wherein the diameter of said reduced diameter portion is between 80 and 160 thousandths less than the diameter of the portion of said roll adjacent said pressure shoe.

4. The press as claimed in claim 1 wherein said belt has a relieved surface in said belt on the said thereof adjacent said roll and extending throughout the lateral portions of said belt disposed laterally outwardly of said pressure shoe.

5. The press as claimed in claim 4 wherein the depth of the relief in said relieved surface is between 80 and 160 thousandths of an inch.

6. The press as claimed in claim 1 characterized by a relief in said surface of said belt and said surface of said roll, said relief extending throughout the portions of said roll and said belt extending laterally outwardly of said pressure shoe.

7. The press as claimed in claim 6 wherein the total combined relief in said roll and said belt is between 80 and 160 thousandths of an inch.

* * * * *